United States Patent [19]

Fischer

[11] 4,391,596

[45] Jul. 5, 1983

[54] FOLDER

[75] Inventor: Rudolf Fischer, Ludwigshafen-Oggersheim, Fed. Rep. of Germany

[73] Assignee: Albert-Frankenthal AG, Frankenthal, Fed. Rep. of Germany

[21] Appl. No.: 288,349

[22] Filed: Jul. 30, 1981

[30] Foreign Application Priority Data

Aug. 14, 1980 [DE] Fed. Rep. of Germany ..... 3030706

[51] Int. Cl.[3] ..... B65H 45/16

[52] U.S. Cl. ..... 493/425; 493/432

[58] Field of Search ..... 270/21.1, 6, 10, 13, 270/19, 38, 42, 43, 47–50, 60; 493/428, 429, 425–432

[56] References Cited

U.S. PATENT DOCUMENTS

| | | | |
|---|---|---|---|
| 2,353,609 | 7/1944 | Zuckerman | 493/428 |
| 3,758,102 | 9/1973 | Munn | 493/432 X |
| 3,787,041 | 1/1974 | Hertrich | 493/432 X |

FOREIGN PATENT DOCUMENTS

| | | | |
|---|---|---|---|
| 2732641 | 2/1978 | Fed. Rep. of Germany | 493/428 |

*Primary Examiner*—A. J. Heinz

*Attorney, Agent, or Firm*—Allison C. Collard; Thomas M. Galgano

[57] ABSTRACT

A folder has at least two transverse paper cutters, each with folding blades for use with a fold jaw cylinder for sheeting and folding paper web coming from a printing press and forwarding the sheets produced to a delivery station.

The one or the other transverse cutter (as put into operation on makeready) is used for producing sheet sizes answering to the full or half of the plate cylinder circumference of the printing press.

The fold jaw cylinder has tool take-up or fixing positions spaced about its circumference with a spacing equal to half the smaller sheet size to be processed. The fold jaw cylinder is designed to have fixed thereon fold jaws with a spacing therebetween equal to the spacing between the folding blades of the one or the other cutter used at the time and to have fixed thereon scissor or shear cutting knives, running out past its circumference radially and spaced to the back of the jaws (in the direction of running) by half the jaw-to-jaw distance.

There is furthermore a knife cylinder between the cutters and the delivery station. This knife cylinder has a circumference at least equal to the largest paper size and is designed to take up knives for use with knives on the fold jaw cylinder.

9 Claims, 2 Drawing Figures

FOLDER

BACKGROUND OF THE INVENTION

The present invention is with respect to a folder, having at least one fold jaw cylinder for use in cooperation with a cylinder, having at least one folding blade, of a transverse paper cutter able to be activated as desired, for sheeting a paper web and forwarding sheets cut from said web to a delivery station.

The printed image produced on a web in a printing press is dependent on the imposition of the different pages on the printing plate. Dependent on the form of the image on the plate, the paper web is cut up into sheets with a length equal to the full circumference of the plate cylinder, or of only part of the circumference, that is to say normally half the circumference of the plate cylinder. The transverse cutters normally have sawtooth cutting blades so that the cut produced is rough and uneven and less pleasing to the eye. For this reason, the paper edge with the sawtooth cut is frequently cut back smooth. Presently, there is no folder in existence, on which products cut not only to the size of the full plate cylinder, but furthermore to half this size may have their edges cut back with straight cuts for cutting off the edge strips with the rough, sawtooth cut.

SHORT OUTLINE OF THE INVENTION

Taking the present condition of the prior art as a starting point, one purpose of the present invention is that of designing a folder of the sort noted that it may be put to a greater number of different uses and in fact may be used for cutting down the paper web to different paper sizes, such sizes being more specially a size representative of the full circumference of the press plate cylinder and a further size equal to half its circumference. A further purpose of the present invention is that of designing such a folder in which edges of the sheets with sawtooth cuts may be cut off in the folder itself so that the delivered products coming from the folder are not in need of any after-processing.

For effecting this purpose and further purposes, the fold jaw cylinder has at least two transverse cutters for cutting two different page sizes and of which one may be put into an active condition at a time, and the fold jaw cylinder has a circumference division representative of half the smallest page size to be cut to, such division being marked by tool fixing positions and the fold jaw cylinder may have fixed thereon fold jaws spaced by the distance between said folding blades of said transverse cutter, which is at the time made active and to have fixed thereon scissor cutting knives, which are positioned further back (in the direction of turning) from the fold jaw by a distance equal to half the spacing between the fold jaws, such scissor cutting knives running out radially past the circumferential outline of said fold jaw cylinder. Furthermore, a paper knife is placed in the folder for cutting paper on the fold jaw cylinder at a point past said cutters in the direction of turning of said fold jaw cylinder and before said delivery station, the circumference of the paper knife cylinder answering to at least the greatest paper size to which said web is to be cut. The paper knife cylinder is designed to have fixed thereon, with the same spacing as the scissor cutting knives of the fold jaw cylinder, further scissor cutting knives for use with said scissor cutting knives on said fold jaw cylinder.

Even although, with these design points, the folder is a many-purpose folder, the structure is nevertheless simple and straightforward, because all transverse cutters may generally be said to have a common fold jaw cylinder and for producing the desired smooth cut, generally speaking, only one knife cylinder is needed for use with the fold jaw cylinder. Because the smooth cutting system is made part of the folder, work is rationalized for the reason that "three-side cutters" used in the prior art for this purpose, are no longer necessary. Even so, the paper may still be smoothly cut true to size and, furthermore, the pressman is freer to make changes in the position of the smooth cut than is the case on using a three-side cutter.

As a further development of the general teachings of the invention, for making certain of ordered, regular transport of the strips cut off by the scissor cutting knives, the knife cylinder may have pins for pinning paper on it, the pins being positioned on the cylinder to the back in the direction of turning, of the scissor cutting knives to be fixed on the cylinder. More specially, the pins are fixed in position. As a further development of the invention there are back-up cushions made of foam material on the fold jaw cylinder for use with the pins, to cushions being spaced from the scissor cutting knives. In order to take up the strips from the pins, the knife cylinder may be acted upon by an aspiration duct.

A further meaasure of good effect forming part of the present invention is such that the fold jaw cylinder may have fixed thereon folding and cutting tools which may be taken off and exchanged for further tools. With this development in the design, even in the case of a generally small cylinder circumference, the system may be changed over, by exchanging the tools, to be in line with the transverse cutter which is activated at the time. A good effect is produced in this case if the exchangeable folding and cutting tools have their own boxes, which may be put in position whenever desired by slipping them into cylinder pockets formed by radial grooves. With this development in the design, the makeready time is greatly decreased.

LIST OF FIGURES

Further useful developments of the general teachings of the present invention will be seen from the account, now to be given, of a preferred working example, to be seen in the figures, and the claims.

DETAILED ACCOUNT OF WORKING EXAMPLE OF THE INVENTION

Figure 1:
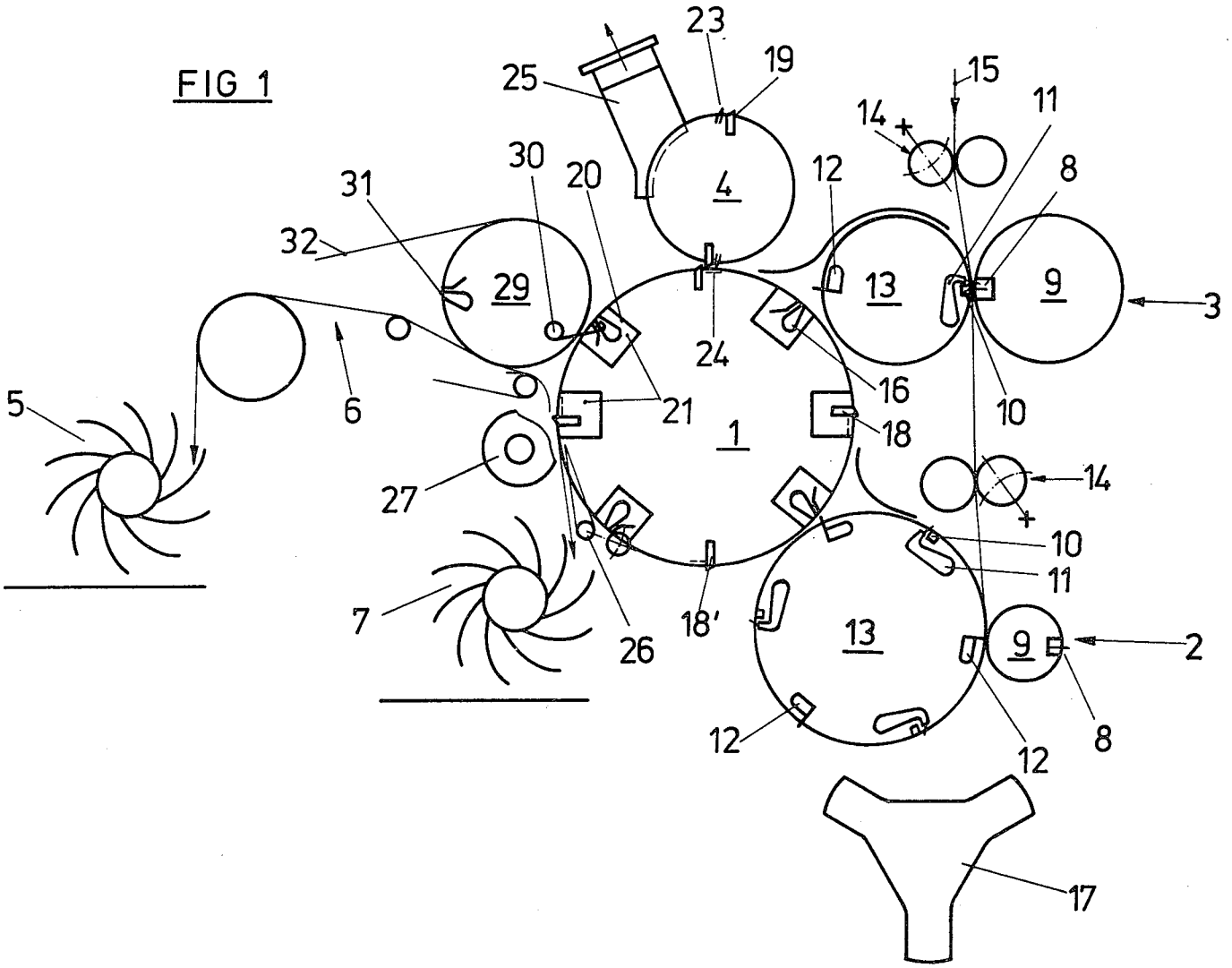
FIG. 1 is a view of a folder of the present invention with two transverse cutters, the cutter in operation at the time being for cutting the web to a size equal to half the circumference of the plate cylinder.

The folder to be seen in the figures is made up of a middle fold jaw cylinder 1 with evenly spaced pockets in its outer face for different folding and cutting parts so that there is an even division of the cylinder's circumference. Placed round the fold jaw cylinder there are two cutters 2 and 3, the knife cylinder 4 further round the fold jaw cylinder 1 in its direction of turning, and a belt guiding system 6 forwarding sheets to a delivery fan wheel 5. Furthermore, under the belt guiding system 6 there is a fan delivery wheel 7 for delivery straight from the fold jaw cylinder 1 without any belt guiding system. Transverse cutters 2 and 3 are, in each case, made up of a cylinder 9 having a transverse cutting knife 8, and on the other hand the cylinder 13 next to cylinder 9 and having one or more cutting openings 10 for use with the cutting knives 8 and, next to the opening 10, pins 11 for pinning paper to the cylinder and furthermore folding blades 12 causing division up of the stretch of cylinder circumference between one or the other cutting opening 10 and the next one. Each cutter 2 and 3 has its own pair 14 of nip rollers. The cutter 2, seen to be activated in FIG. 1 does the cutting of the web 15 to sheets equal in size to half the plate cylinder circumference in length. The paper web 15 comes down to the folder over a former folder (not figured). On the other hand, the cutter 3, seen to be activated in FIG. 2, does the cutting up of the paper web into sheets with a size length answering to the full circumference of the plate cylinder. The cylinder 9 having the cutting knife 8 has, in each case, a different diameter in line with the length of cut. For inactivating the cutter 2 or 3 which is not needed for a given job, the cutting knives 8 are taken out of the cylinders and the pins 11 and folding blades 12 are fixed in position. The pair 14 of nip rollers may be put out of operation as well by rocking one nip roller clear of the other (see chained lines in FIG. 2).

Cylinder 13 of the cutter 2, which is activated in FIG. 1, for use on producing the smaller paper size, has three lines of pins 11 and three folding blades 12 on its circumference. The diameter of the cylinder 13 is, for this reason, equal to three times the diameter of the cylinder 9 used therewith and having the cutting knife 8, the circumference of cylinder 9 being equal to half that of the plate cylinder. Cylinder 13 of the transverse cutter 3, seen to be activated in FIG. 2, which does the cutting to the larger paper size, has the same diameter as the cylinder 9 used therewith and which has a size in line with that of the plate cylinder diameter. Cylinder 13 has one line of pins 11 and opposite thereto a folding blade 12. Folding blade(s) 12 of the transverse cutter 2 or 3, which is activated for a given printing operation, is used in a known way with the fold jaws 16 of cylinder 1. The folding blades 12 and the fold jaws 16 used therewith are, in this respect, so timed that they go through the line of touching, between cylinder 1 and the activated cylinder 13, together, and the sheets pinned by pins 11 at their lead edge are forced into the nearest fold jaw 16, the folding blades 12 then letting the paper go, a transverse fold being formed in the sheet. The lines of pins 11 pinning the sheet, cut from the web 15, at its lead edge further make possible a collect run, the collected pages or sheets then being forwarded together by cylinder 1. The collected sheets may be stapled at the position where eventually the transverse fold will be made. In the present working example, this is only desired at the transverse cutter 2. For this reason, cylinder 13 of transverse cutter 2 has one stapling cylinder 17, which has the same diameter and, for this reason, has three stapling stations. Cylinder 1 has, next to fold jaws 16, scissor cutting knives 18, which are placed after the fold jaws 16 in the direction of turning. Knives 18 are, in each case, placed in the middle between two fold jaws 16 coming one after the other and the fold jaw which is the next one in the direction of turning. The shear or scissor cutting knives 18, designed for producing smooth cuts parallel to the transverse fold at the back edge of the sheets on the cylinder 1 and kept in position by fold jaws 16, are, in each case, used with the second scissor cutting knife 19 placed on the knife cylinder 4. Because of this smooth cut, parallel to the transverse fold, the sawtooth cut strip produced with the cutter 2 or 3, which is activated at the time, and having the holes made by pins 11, may be taken off.

Cylinder 1 has such a division of its circumference that, on being used with the transverse cutter 3, which does the cutting to the larger page size, at least two fold jaws 16 are on hand which are evenly spaced round its circumference. When the cylinder 1 is used with the smaller size cutter 2 (see FIG. 1) there is a representatively greater number of fold jaws 16 evenly spaced round the circumference. Furthermore, there are scissor cutting knives 18 which are placed after the fold jaws with a spacing equal to half the fold jaws spacing. In the working example to be seen, there is a 45° division up of the circumference of cylinder 1 so that there are eight tool take-up positions, the spacing thereof being equal to half the paper cut size, which is equal to half the plate cylinder circumference and is produced using cutter 2 which is activated in FIG. 1. In FIG. 1, cylinder 1 will be seen to have fixed thereon four fold jaws 16, which are spaced by 90° and four scissor cutting knives 18, spaced out to the back thereof by an angle of 45° in each case. On activating cutter 3 (see FIG. 2), use is made of two fold jaws 16, spaced by 180° and two scissor cutting knives 18' placed to the back of the fold jaws 16 by 90°. The rest of the tool fixing or take-up positions on cylinder 1 may be kept unused or have different tools fixed thereto, as will be made clear later.

Figure 2:
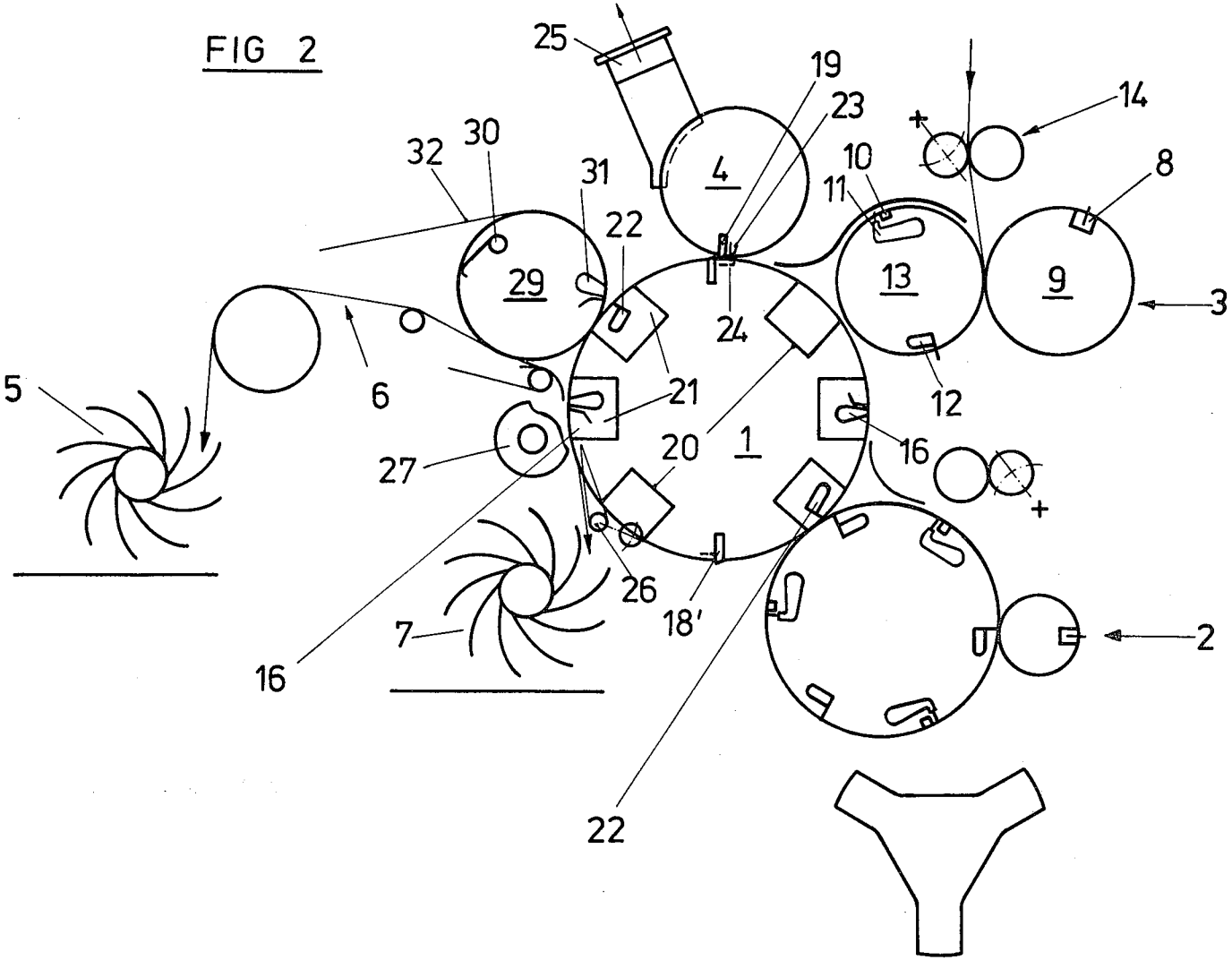
FIG. 2 is a view of the same folder in the case of which the other transverse cutter has been activated for cutting to a paper size answering to the full plate cylinder circumference.

On making a comparison between FIGS. 1 and 2, the reader will see that two scissor cutting knives, spaced by 180°, are used in the two cases, such knives, for this reason, being able to be fixed permanently to the cylinder as marked at 18'. In place of the scissor cutting knives (spaced by 90° for processing the smaller cut size) on processing the larger cut size, fold jaws will be needed. To make certain that the fold and cutting tools to be fixed to cylinder 1 may simply be changed round and changed over, cylinder 1 has tool take-up pockets, at least at the positions at which the tools are to be fixed, such pockets being formed by radial grooves 20 and being designed for taking up boxes 21 with the tools so that the exchange of tools may be undertaken quickly and simply. Boxes 21 may have high speed locks for locking the same. The fold jaws 16 used in the condition of the folder to be seen in FIG. 1, and whose space or position is not needed when the folder is made ready as in FIG. 2, only have to be inactivated. In the case of operation as in FIG. 2, between each fold jaw 16 and its scissor cutting knife 18, coming after it in the direction of turning, there is a free tool take-up position in which, in the present working example addressed, is used for a box 21 with a folding blade 22 for producing a second transverse fold.

In line with the changes made on cylinder 1, the knife cylinder 4 may furthermore be so made ready that each time a shear or scissor cutting knife 18 comes up against the paper, a second scissor cutting knife 19 is on hand. In the working example in question, the working circumference of the knife cylinder 4 is equal to the largest paper or sheet size cut on the cutter 3 which is activated in FIG. 2. As long as the cutter 2, used for cutting to the smaller size, is activated, the knife cylinder 4 is, as may be seen from FIG. 1, used with two opposite scissor cutting knives 19, which are best made so that they may be taken off the cylinder. For makeready for an operation with the folder in the condition of FIG. 2, one scissor cutting knife 19 is taken off. The scissor cutting knives 19 of the knife cylinder 4 have lines of pins 23 which are placed at the back of them in the direction of turning and which take up the cut off strips produced on smoothly cutting with the scissor cutting knives 18 and 19. The lines of pins 23, which are best fixed in relation to the scissor cutting knives 19 next thereto, may each have a back-up cushion 24 on the next cylinder 1, the cushion being made of foam material and which, if boxes 21 are used, may be placed on the box together with the scissor cutting knife 18 next thereto. The knife cylinder 4 is placed at the end of an aspiration duct for aspiration at a position coming after the position of smooth cutting of the cut off strips. In the present working example the knife cylinder is, for this reason, placed within the aspiration duct 25 at a position coming after the position of smooth cutting.

The sheets positioned on cylinder 1, which have a transverse fold and have edges cut parallel thereto, are taken off at the belt guiding system 6 or the delivery fan wheel 7 placed thereafter in the direction of turning of cylinder 1. The sheets have to be lifted out of the fold jaws 16 for this purpose. For this reason, near the delivery fan wheel 7, there is a powered blade 26 having fingers which are pushed under the products to be lifted clear of the fold jaws 16. For causing safe and regular transport of the products cleared from any fold jaw 16 which is moved past the powered blade 26, there is a pinch roller 27 to be used with the cylinder 1 and positioned between the belt guiding system 6 and the delivery fan wheel. The scissor cutting knives 18 of cylinder 1 are radially further out than the general outline of the cylinder circumference. The powered blade 26 is, for this reason, so moved that its fingers are moved clear of and over the outwardly running edges of the scissor cutting knives 16 as they are moved past it. The products forwarded to the delivery fan wheel 7 are, for this reason, simply lifted at their back edges from cylinder 1 for a small distance. For producing the necessary free space, the pinch roller 27 has a part of decreased diameter which is nearest to cylinder 1 when the scissor cutting knives 16 go by. The pinch roller 27 is so turned that the outer face thereof with the full diameter is moved with the same peripheral speed as cylinder 1. Pinch roller 27 may be simply made of threaded rod with cams on it which are cut back as necessary. In the resting condition with the belt guiding system 6 activated, the pinch roller 27 may simply be so stopped that its part of lesser diameter is turned towards cylinder 1. Driving is, in this case, best by way of a dog clutch. For driving the powered blade 26, a simple system in the form of a cam may be used placed at the end of cylinder 1 and driving a follower 28. Powered blade 26 may furthermore be run when the delivery fan wheel 7 is inactivated to make certain that there is nothing in the way of the scissor cutting knives 16. It would furthermore, however, be quite possible for the powered blade 26 simply to be rocked so far clear of cylinder 1 there would be no chance of its getting in the way of the scissor cutting knives, when powered blade 26 is not needed.

At a position near the belt guiding system 6 there is a take-up cylinder 29 for lifting the sheets from the fold jaws 16, cylinder 29 having lifting grippers 30 which are moved into fold jaws 16 and take over the sheets, which are to be handed over to the belt guiding system so that they are, in fact, pulled into such system. The take-over cylinder 29 is at such a distance from cylinder 1 that the scissor cutting knives 14, spaced round its circumference, do not have anything in their way. The lifting grippers 30 are, because of the turning of the take-over cylinder 29, automatically moved clear of the scissor cutting knives 14. The lifting grippers 30 may, in this respect, be best so moved that the sheets which are to be forwarded to the belt guiding system 6 are taken up even at the position of the fold jaw 16 as it is moved by, and only let go of when they have been safely and regularly taken up in the belt guiding system which, in a known way, is made up of a top belt group and a lower belt group, the belts in each group being placed side by side so that the lifting grippers 30 may be moved into position between the belts. For moving the lifting grippers 30, it is possible to have a simple system with a cam placed near the end of the take-over cylinder 29 and fixed to the frame of the folder, and on which a follower is run joined up by way of a shaft with the lifting grippers 30. The circumference of the take-over cylinder 29 is equal to the circumference of the knife cylinder 4 next thereto. On producing sheets cut to the full circumference size as in FIG. 2, the take-over cylinder 29 is used with a shaft having lifting grippers 30 and when the folder is made ready in this way, on producing sheets cut to half the circumference in size as in FIG. 1, every second sheet is lifted out. The delivery fan wheels 5 and 7 may, in this respect, get the sheets in turn. If, however, the delivery wheel 7 is inactivated and the delivery wheel 5 is to get all the sheets, it is necessary to have two shafts, placed opposite each other and having the lifting grippers 30 to be in line with the groups of knives fixed to the knife cylinder 4.

In the case of folding products, cut to the full circumference of the plate cylinder, see FIG. 2, such products may be given a second transverse fold using the folding blades 22 placed in this case between the two fold jaws 16 and their scissors cutting knives 18. In this case, the take-over cylinder 29 may have fixed on it a fold jaw 31 for use with the folding blades 22, such fold jaw 31 simply being put in to take the place of a line of grippers. The line of grippers 30 which is opposite in each case may, as well, be taken off or simply inactivated when the fold jaw 31 is activated. This condition will be seen in FIG. 2. In the case of the condition of the folder to be seen in FIG. 1 with the sheets being forwarded in turn to the two delivery fan wheels 5 and 7, the fold jaw 31, placed opposite to the activated lifting out grippers 30, is simply inactivated. For driving or controlling the fold jaw 31, a simply system may be used having a cam on one side of the folder.

In the working example in the figures, the take-over cylinder 29 takes the form of the guide roller, next to cylinder 1, of the group of belts of the belt guiding system 6, moving towards cylinder 1. For this reason, the belts 32 of the top belt group are trained round the take-over cylinder 29, the belts of the lower belt group furthermore touching cylinder 29. While the design of the take-over cylinder 29 as part of the belt guiding system 6 as well, the products being transported are very truly positioned so that, in the case of a working station placed on the inlet side of the delivery fan wheel 5 (for example in the form of a blade folder for producing a further lengthways fold) it may well be responsible for the system working very regularly and exactly. At the fold jaw 31, the belts 32 may be simply trained in belt grooves, lower than the full circumference of the cylinder, the grooves being so deep that the fold jaw 31 (whose parts are placed between the separate belts) may be got at from the outside by the pressman. It would, however, furthermore be possible for the take-over cylinder 29 to have a moving blade, having lifting out fingers generally on the same lines as at part 26, such fingers being moved inbetween the grippers and the fold jaw. In this case, the take-over cylinder 29 would not have any belt trained round it. If the delivery fan wheel 7 is the only wheel used, the belt guiding system 6 would be inactivated, this simply being done by stopping the lifting out grippers 30 and the fold jaw 31. It would, however, be possible for the take-over cylinder 29 and the complete belt guiding system 6 to be powered by way of a dog clutch with a locking pin which would simply be pulled clear for stopping or inactivating part of the system.

It will be seen from the account given of FIGS. 1 and 2 that the folder of the present invention may be said to be a many-purpose folder with a small number of basic parts and which, on changing over from one line of production to an other, as for example from products which only have one cross-fold to those having two cross-folds, make-ready is generally simple.

I claim:

1. In a folder adapted for two different cutting formats, one format cutting sheets of one half plate cylinder circumference and the second format cutting sheets of full plate cylinder circumference, said folder comprising a fold jaw cylinder, at least two transverse paper cutters circumferentially spaced about said folding jaw cylinder and located in a transverse paper cutting station, each transverse cutter including a folding blade cylinder having at least one folding blade, each folding blade cylinder being adapted to cooperate with said fold jaw cylinder to fold a sheet cut from a web by one of said paper cutters and for forwarding the sheets to a delivery station, means for making one of said transverse paper cutters active one at a time, said fold jaw cylinder having tool support points circumferentially disposed in equal spaced apart relationship corresponding to one half the smallest paper size to be cut, fold jaws removably positioned in certain of said tool support points cooperating with the folding blades of the active transverse cutter, spaced-apart scissor cutting blades for cutting a paper web into cut sheets some of which are removably positioned in tool support points alternating with said fold jaws, said scissor cutting blades running radially ouutwardly from said fold jaw cylinder, and a knife cylinder for cutting said paper web in cooperation with said scissor cutting blades of said fold jaw cylinder to provide a smooth cut to said cut sheets, said knife cylinder being disposed between said transverse paper cutting station and said delivery station, the circumference of said paper knife cylinder being equal to at least the greatest paper size to which said web is to be cut, said knife cylinder being adapted to have removably positioned thereon, with the same spacing of said scissor cutting blades of said fold jaw cylinder, further scissor cutting blades for use in cooperation with said scissor cutting blades of said fold jaw cylinder, whereby the removable fold jaws and scissor cutting blades of the fold jaw cylinder and the removable scissor cutting blades of the knife cylinder are removed or installed to cooperate with the active transverse paper cutter.

2. The folder of claim 1 having pins for pinning paper on said knife cylinder, said pins being positioned on the same, in the direction of turning, behind said scissor cutting blades to be positioned on said scissor knife cylinder.

3. The folder as claimed in claim 2, having an aspiration duct opening onto said scissor knife cylinder at the circumference thereof positioned after a cutting station of said scissor cutting blades in the direction of turning.

4. The folder as claimed in claim 2 wherein said pins are in locked position on said scissor knife cylinder.

5. The folder as claimed in claim 2 having a belt guiding system for use with said fold jaw cylinder, a take-over cylinder near said belt system and said fold jaw cylinder, said take-over cylinder having, at the same spacing about its circumference as the fold jaws of the fold cylinder, powered lift-out grippers which are moved clear of the scissor cutting blades by the turning motion of the take-up cylinder.

6. The folder as claimed in claim 5, wherein said fold jaw cylinder is adapted to have fixed thereon folding blades at positions near a free tool support point between a fold jaw and the scissor cutting blade coming thereafter in the direction of turning, said take-over cylinder being adapted to have fixed thereon at least one fold jaw for use with the said folding blades.

7. The folder as claimed in claim 6, wherein the take-over cylinder has top belts of said belt guiding system trained about it, said cylinder having in its part near the fold jaw grooves for taking up the belts of the belt guiding system, said grooves being a depth at least equal to the working depth of the fold jaw.

8. The folder as claimed in claim 1 wherein said tool support points are radial grooves formed in said fold jaw cylinder and said fold jaws and scissor cutting blades of said fold jaw cylinder are fitted to equal sized boxes adapted to fit in said radial grooves.

9. The folder as claimed in claim 8 having a delivery fan wheel positioned adjacent said fold jaw cylinder in the direction of paper transport, a powered blade on a side of the fold jaw cylinder near said delivery station, said powered blade being adapted to be moved into pockets in said fold jaw cylinder for said fold jaws and having lifting out fingers, and a pinch roller near said powered blade having its circumference cut back to let past said scissor cutting blades on said fold jaw cylinder.

* * * * *